US009080280B2

(12) United States Patent
Koops

(10) Patent No.: US 9,080,280 B2
(45) Date of Patent: Jul. 14, 2015

(54) TUMBLE DRYER

(76) Inventor: Andries Koops, Apeldoorn (NL)

( * ) Notice: Subject to any disclaimer, the term of this patent is extended or adjusted under 35 U.S.C. 154(b) by 461 days.

(21) Appl. No.: 13/379,331

(22) PCT Filed: Jun. 23, 2010

(86) PCT No.: PCT/NL2010/050391

§ 371 (c)(1),
(2), (4) Date: Mar. 16, 2012

(87) PCT Pub. No.: WO2010/151128

PCT Pub. Date: Dec. 29, 2010

(65) Prior Publication Data

US 2012/0167411 A1 Jul. 5, 2012

(30) Foreign Application Priority Data

Jun. 23, 2009 (NL) ..... 2003076

(51) Int. Cl.

| | |
|---|---|
| ***F26B 11/02*** | (2006.01) |
| ***D06F 58/20*** | (2006.01) |
| ***D06F 58/02*** | (2006.01) |
| ***D06F 58/28*** | (2006.01) |

(52) U.S. Cl.

CPC ..... *D06F 58/02* (2013.01); *D06F 58/20* (2013.01); *D06F 58/28* (2013.01); *D06F 2058/2864* (2013.01)

(58) Field of Classification Search

USPC ..... 34/595, 601, 602, 606, 610; 68/5 C, 5 R, 68/19, 20; 8/137, 149, 159

See application file for complete search history.

(56) References Cited

U.S. PATENT DOCUMENTS

| | | | | |
|---|---|---|---|---|
| 2,931,687 | A * | 4/1960 | Mitter | 312/323 |
| 4,103,433 | A * | 8/1978 | Taylor | 34/86 |
| 4,112,590 | A * | 9/1978 | Muller | 34/75 |
| 5,228,212 | A * | 7/1993 | Turetta et al. | 34/493 |
| 6,088,932 | A * | 7/2000 | Adamski et al. | 34/274 |
| 7,020,985 | B2 * | 4/2006 | Casey et al. | 34/595 |
| 7,322,126 | B2 * | 1/2008 | Beaulac | 34/554 |
| 7,347,009 | B2 * | 3/2008 | Ahn et al. | 34/607 |
| 7,458,171 | B1 * | 12/2008 | Lentz | 34/75 |

(Continued)

FOREIGN PATENT DOCUMENTS

| | | | |
|---|---|---|---|
| DE | 2149289 | | 4/1973 |
| DE | 24 27 461 | * | 1/1975 |

(Continued)

*Primary Examiner* — Steve M Gravini
(74) *Attorney, Agent, or Firm* — Workman Nydegger

(57) ABSTRACT

Tumble dryer (301) comprising a drum (302) that is rotatably positioned for containing laundry, and furthermore a blower (341) and an air inlet system (332) for via an air inlet supplying air to the drum (302). The tumble dryer (301) comprises a control system (305) for controlling at least a drive of the drum and the blower (341). A first stationary wall (371) of the tumble dryer (301) is placed near a first end surface of the drum (302) and a second stationary wall (372) is placed near a second end surface of the drum. The first wall is provided with a first air supply opening (311) and the second wall with a first air discharge opening (322). The first air supply opening (311) is placed substantially at a lower side of the first wall (371), and the first air discharge opening (322) is placed substantially at an upper side of the second wall (372), wherein the blower (341) is placed upstream from the first air supply opening (311) for blowing air through the first air supply opening into the drum.

23 Claims, 7 Drawing Sheets

(56) References Cited

U.S. PATENT DOCUMENTS

| | | | | |
|---|---|---|---|---|
| 7,765,716 | B2 * | 8/2010 | Kim | 34/602 |
| 8,418,377 | B2 * | 4/2013 | Grunert et al. | 34/86 |
| 8,601,717 | B2 * | 12/2013 | Beers et al. | 34/419 |
| 2008/0113609 | A1 * | 5/2008 | Ehlers | 454/241 |

FOREIGN PATENT DOCUMENTS

| | | | |
|---|---|---|---|
| DE | 295 20 211 | U1 | 4/1997 |
| EP | 0 395 484 | * | 10/1990 |
| EP | 481 442 | A2 | 4/1992 |
| EP | 1 264 928 | A2 | 12/2002 |
| EP | 1 389 644 | A1 | 2/2004 |
| EP | 1 580 314 | A1 | 9/2005 |
| EP | 1 790 769 | A1 | 11/2005 |
| FR | 933 996 | | 5/1948 |
| GB | 1 434 607 | | 5/1976 |
| GB | 2 095 806 | * | 10/1982 |
| WO | WO 92/07988 | | 5/1992 |

* cited by examiner

TUMBLE DRYER

This is a non-provisional application claiming the benefit of International application number PCT/NL2010/050391, filed Jun. 23, 2010.

BACKGROUND OF THE INVENTION

The invention relates to a tumble dryer, particularly for at least partially drying laundry using substantially unheated ambient air, comprising a drum, also called tumbler, that is rotatably positioned for containing laundry, and an air inlet system for supplying air to the drum, wherein the air inlet system has a first air inlet for sucking in air.

Such a tumble dryer is known from U.S. Pat. No. 7,340,848. Said document describes a tumble dryer provided with a drum in which wet laundry can be blown dry by unheated ambient air to be supplied near a first head-end side of the drum and to be discharged near a second head-end side of the drum facing away from the first head-end side.

A drawback of said tumble dryer is that when the tumble dryer is being used in an interior room, the air humidity of the interior room increases and as a result the ambient air to be supplied will also have a higher air humidity, which may even exceed the air humidity outside of the house, to the detriment of the efficiency of the drying process. Said tumble dryer therefore is only suitable to be placed outside of the house.

It is an object of the invention to provide an improved tumble dryer that preferably can be placed inside the house for drying laundry in a drum using ambient air, without heating said air prior to supplying it to the drum, wherein for drying clothes optimal use can be made of the ambient air.

SUMMARY OF THE INVENTION

According to a first aspect the invention provides a tumble dryer comprising a drum that is rotatably positioned for containing laundry, and an air inlet system for via an air inlet supplying air to the drum, and a control system for controlling at least a drive of the drum and a blower, wherein a first stationary wall is placed near a first end surface of the drum and a second stationary wall is placed near a second end surface of the drum, wherein the first wall is provided with a first air supply opening and the second wall with a first air discharge opening, wherein the first air supply opening is placed substantially at a lower side of the first wall, in that the first air discharge opening is placed substantially at an upper side of the second wall, and wherein the blower is placed upstream from the first air supply opening for blowing air through the first air supply opening into the drum. This measure makes it possible to blow air into the drum via the lower side of the first wall, for substantially aerating laundry substantially from below. By discharging air at the upper side of the drum, an air flow that rises downstream is realised, wherein laundry is lifted and as a result takes up a larger volume, which has an advantageous effect on the drying process of the laundry. This effect is enhanced by according to the invention placing the blower before the first air supply opening. It is noted here that usually the blower is placed behind the air discharge opening for sucking air through the drum. This combination of measures makes it possible to make use of unheated ambient air for at least a part of the drying process for drying laundry, as a result of which the tumble dryer according to the invention can be highly energy efficient.

In one embodiment the second wall is provided with a second air supply opening, wherein the second air supply opening is placed substantially at a lower side of the second wall. In a first embodiment the air inlet system is adapted for blowing air into the drum alternately through the first and the second air supply opening. In a second embodiment the air inlet system is adapted for blowing air into the drum simultaneously through the first and second air supply opening. This measure makes it possible to blow in air simultaneously or alternately via the first and second air supply opening. By simultaneously or alternately blowing the laundry from several sides a strongly improved, particularly quicker, drying process is achieved.

In one embodiment the first wall is provided with a second air discharge opening, wherein the second air discharge opening is placed substantially at an upper side of the first wall. In a first embodiment the tumble dryer is adapted for discharging air out of the drum alternately via the first and the second air discharge opening. In a second embodiment the tumble dryer is adapted for discharging air out of the drum substantially simultaneously via the first and the second air discharge opening. This measure makes it possible to discharge air out of the drum simultaneously or alternately via the first and second air discharge opening for obtaining an air flow through the drum that is advantageous to the drying process.

In one embodiment the first air supply opening and the second air discharge opening are placed substantially diametrically to a centre line of the drum and near the circumferential wall of the first wall and/or the second air supply opening and the first air discharge opening are placed substantially diametrically to a centre line of the drum and near the circumferential wall of the second wall. As a result it becomes possible to let an air flow flow from the first wall to the second wall spaced as far apart as possible as an air flow from the second wall to the first wall. By placing the air supply on the first wall as far apart as possible from the air discharge a larger spread of air flows is obtained which is beneficial to the speed of the drying process.

In one embodiment the tumble dryer is adapted for alternately generating a first and second air flow, wherein the first air flow enters the drum via the first air supply opening and leaves the drum via the first air discharge opening, and wherein the second air flow enters the drum via the second air supply opening and leaves the drum via the second air discharge opening. By alternating the first air flow, flowing through the drum according to a substantially first diagonal, and the second air flow, flowing through the drum according to a substantially second diagonal, the drying process is improved and accelerated.

In one embodiment the tumble dryer is adapted for when changing the air flow also reversing the direction of rotation of the drum. However preferably the tumble dryer is adapted for during alternately generating the first and second air flow, keeping the direction of rotation of the drum substantially the same. In that way the mechanical and/or electronic structure of the tumble dryer can be strongly simplified and yet a proper drying process is still obtained.

In one embodiment the first and second end surface of the drum are provided with a shaft, wherein the shaft on both sides of the drum is rotatably connected, particularly via a bearing, to the first and second stationary wall, respectively. Because the drum is suspended so as to be bearing mounted on both sides, a smooth run of the drum with relatively little friction is obtained, which has an advantageous effect on the required energy for driving the rotation of the drum. This embodiment may thus provide an energy efficient tumble dryer.

In one embodiment the air inlet system comprises a branching for sucking in air, and the air inlet system comprises first switching elements for switching between a first condition wherein the air inlet is in fluid connection with the first air supply opening and a second condition wherein the air inlet is in fluid connection with the second air supply opening. As a result by operating the switching elements, air can be blown into the drum in a simple manner alternately via the first air supply opening or via the second air supply opening.

In one embodiment the control system is adapted for operating at least the first switching elements. This measure makes it possible to let the control system carry out the switching of the first switching elements between the first condition and the second condition.

In one embodiment the first switching elements comprise one valve placed in or near the branching, wherein the valve can be placed in a first position wherein the air inlet is in fluid connection with the first air supply opening and a second position wherein the air inlet is in fluid connection with the second air supply opening. In that way it becomes possible to substantially close off the second air supply opening in the second position and substantially closing off the first air supply opening in the first position, for directing the air flow through the drum.

In one embodiment the blower is adapted for, at least when operational, supplying a flow rate to the drum. Preferably the flow rate is in a range of 600 to 1600 times the volume of the drum per hour. In that way a quicker drying process and thus a shorter drying time is achieved.

In one embodiment the flow rate exceeds 600 $m^3$ per hour, preferably exceeds 800 $m^3$ per hour, more preferably exceeds 1000 $m^3$.

In one embodiment the tumble dryer is adapted for drying laundry in the drum using an air flow at a substantially ambient temperature of the air. Particularly drying laundry without using a heating element results in a highly energy efficient tumble dryer.

In one embodiment the tumble dryer is provided with an after-heating element. In one embodiment the control device is adapted for controlling the after-heating element for, when necessary, at or towards the end of the drying process heating the air flow for drying the laundry. It has turned out that the major part of moisture can be extracted from laundry by drying without heating element. However, particularly when the air humidity of the ambient air is high, it may be advantageous to dry with heated air for a short while at or towards the end of the drying process in order to achieve the required degree of drying of the laundry, particularly in a relatively short post-drying time of for instance 15 to 30 minutes.

In one embodiment the control device is adapted for switching on the after-heating element when the humidity level of the inflowing air is 70% or higher.

In one embodiment the control device is adapted for switching on the after-heating element after a pre-set time period of drying without after-heating element. Preferably the pre-set time period is longer than or equal to 1 hour, preferably longer than or equal to 2 hours. When the laundry is not sufficiently dry after the pre-set time period, the after-heating element is switched on.

In one embodiment the control device is adapted for switching on the after-heating element when the humidity level of the laundry substantially equals the air humidity of the inflowing air.

In one embodiment the air inlet is a first air inlet, the air inlet system comprises a branching to a second air inlet for sucking in air, and the air inlet system comprises second switching elements for switching between a first condition wherein the drum is in fluid connection with the first air inlet and a second condition wherein the drum is in fluid connection with the second air inlet. This measure provides a tumble dryer wherein by operating the second switching elements, that in particular comprise a valve, a choice can be made to pass air coming from the first air inlet or the second air inlet of the air inlet system to and through the drum. By letting the first air inlet debouch in a first space, for instance inside the house and let the second air inlet debouch in a second space, for instance the outside air, for instance via a wall passage, an ambient air that is optimal for drying laundry can be sucked in.

In one embodiment the control system is adapted for at least operating the second switching elements. This measure makes it possible to let the control system carry out the switching of the second switching elements between the first condition and the second condition.

In one embodiment the air inlet system comprises a first sensor for giving a signal to the control system, which signal corresponds with the air humidity of the air sucked in or to be sucked in. This measure makes it possible to process a signal for the air humidity of the air sucked in or to be sucked in, and on the basis of which the control system is able to operate the second switching elements.

In one embodiment the first sensor is adapted for giving a first signal to the control system, which signal corresponds with the air humidity of the air sucked in or to be sucked in via the first air inlet. These measures makes it possible to process and compare a signal for the air humidity of the air sucked in via the first air inlet or after switching the second switching element, a signal for the air humidity of air sucked in via the second air inlet, and on the basis of which the control system is able to operate the switching elements.

In one embodiment the air inlet system comprises a second sensor for giving a second signal that corresponds with the air humidity of the air sucked in or to be sucked in via the second air inlet. In one embodiment the first sensor is placed near the first air inlet, and the second sensor is placed near the second air inlet. These measures make it possible to process and compare a signal for the air humidity of the air sucked in or to be sucked in, in or near the first air inlet and in or near the second air inlet, and on the basis of which the control, system is able to operate the switching elements.

In one embodiment the second air inlet is provided with a first connecting element for coupling to a pipe. In that way it becomes possible to couple the second air inlet of the air inlet system of a tumble dryer to a pipe that preferably via a wall passage leads to a space outside of the house.

In one embodiment the second sensor is connected to the tumble dryer by means of a signal cable, wherein in or near the first connecting element the signal cable is connected to the tumble dryer and wherein the signal cable is adapted for placement along or in the pipe, wherein the signal cable at least partially extends in the longitudinal direction of the pipe. As a result it becomes possible when arranging the signal cable of the second sensor to use a wall passage through which the pipe is inserted.

In one embodiment the control system is adapted for having the tumble dryer perform the following steps:

reading a signal for a measured value for the air humidity of air sucked in or to be sucked in;

operating the switching elements to:

the first condition when the measured air humidity of the air via the first air inlet is substantially lower than the measured air humidity of the air via the second air inlet of the air inlet system, or the second condition when the measured air humidity of the air via the first air inlet is substantially higher than the measured air humidity of the air via the second air inlet of the air inlet system.

In one embodiment the second switching elements comprise one valve placed in or near the branching, wherein the valve can be placed in a first position wherein the drum is in fluid connection with the first air inlet and a second position wherein the drum is in fluid connection with the second air inlet. As a result it becomes possible to substantially close off the second air inlet in the second position and substantially close off the first air inlet in the first position.

In one embodiment the first air supply opening comprises a substantially horizontally extending slit or several supply openings placed substantially horizontally adjacent to each other for supplying a substantially in horizontal direction wide air flow to the lower side of the first wall. By using a slit or splitting up the inflowing air through several air supply opening situated adjacent to each other, a strongly improved drying process can be achieved. Preferably the slit or the several air supply openings placed adjacent to each other extend over a distance of at least 200 millimeters, more preferably over a distance of at least 300 millimeters. Preferably the slit extends substantially horizontally or substantially parallel to the lower edge of the drum.

In one embodiment a first stationary wall is placed near a first end surface of the drum and a second stationary wall is placed near a second end surface of the drum, wherein the first wall is provided with a first passage for air supply, also called first air supply opening, and a second passage for air discharge, also called second air discharge opening, wherein the second wall is provided with a third passage for air supply, also called second air supply opening, and a fourth passage for air discharge, also called first air discharge opening, wherein a first outer end of a first air supply channel is coupled to the first passage and a first outer end of a second air supply channel is coupled to the third passage, wherein the second outer end of the first and a second air supply channel are connected to the air inlet system, and wherein a first outer end of a first air discharge channel is coupled to the fourth passage and a first outer end of a second air discharge channel is coupled to the second passage, wherein a second outer end of the first and a second air discharge channel are connected to an air outlet system. This measure provides a drum wherein both the first stationary wall and the second stationary wall can be coupled to stationary positioned channels for air supply via the air inlet system and air discharge via the air outlet system, wherein an air flow through the drum becomes possible that can be directed from the first wall to the second wall or from the second wall to the first wall.

In one embodiment the first closing elements are arranged for at choice connecting the first or the second air supply channel to the air inlet system. Said measure provides a tumble dryer wherein air can be supplied to the drum via the first air supply channel when the first closing elements substantially close off the second air supply channel, or can be supplied via the second air supply channel when the first closing elements substantially close off the first air supply channel.

In one embodiment second closing elements are arranged for at choice connecting the first or the second air discharge channel to the air outlet system. This measure provides a tumble dryer wherein air can be discharged from the drum via the first air discharge channel when the second closing elements substantially close off the second air discharge channel, or can be discharged via the second air discharge channel when the second closing elements substantially close off the first air discharge channel.

In one embodiment the control system is adapted for switching the first closing elements and the second closing elements between:

a first condition in which the first closing elements connect the first air supply channel with the air inlet system and substantially close off the second air supply channel, and in which the second closing elements connect the first air discharge channel to the air outlet system and substantially close off the second air discharge channel, and a second condition in which the first closing elements connect the second air supply channel to the air inlet system and substantially close off the first air supply channel, and wherein the second closing elements connect the second air discharge channel to the air outlet system and substantially close off the first air discharge channel. In that way it is possible to alternate airflows through the drum that are oriented opposite each other.

In one embodiment the air outlet system comprises a third sensor for giving a third signal to the control system, which signal corresponds with an air humidity of the air discharged from the drum, which control system is adapted for processing and comparing the third signal to a reference value and periodically operating the first and second closing elements as long as the air humidity measured by the third sensor is substantially higher than the reference value, or operating the first and second closing elements as soon as the air humidity measured by the third sensor is substantially lower than the reference value. Said measure provides a third signal for the air humidity of the air of the air outlet system discharged out of the drum on the basis of which the control system is able to switch the first and second closing elements between the first condition and the second condition, as long as the laundry is not dry yet, or as soon as the air humidity of the air discharged out of the drum is lower than the reference value.

In one embodiment the control system is adapted for switching off a drive of the tumble dryer as soon as both with the first and second switching elements in the first condition and with the first and second switching elements in the second condition the air humidity measured by the third sensor is lower than the reference value. In one embodiment the reference value substantially equals a value for the air humidity of the air to be sucked in measured by the first sensor. In one embodiment the reference value substantially equals a value of the air humidity of air to be sucked in measured by the first or second sensor. In one embodiment the reference value substantially equals 60% air humidity. Said measures provide a tumble dryer wherein the control system uses the air humidity in or near the first air inlet as a criterion for a switch of the air flow through the drum or for the laundry being dry.

In one embodiment the air outlet system is provided with a second connecting element for a coupling to a pipe. In that way it becomes possible to couple the air outlet system of a tumble dryer to a pipe that preferably via a wall passage passes to a space outside the house.

In one embodiment the first and the third passage are situated substantially mirror-symmetrical from a centre plane extending transverse to the centre line of the drum. This measure makes it possible to pass air diagonally through the drum in order to generate an air flow extending as long as possible through the drum, wherein the air flow is able to take up a maximum quantity of moisture.

In one embodiment a first blower is placed in the first air supply channel for air passage via the first air supply channel through the drum to the first air discharge channel, and a second blower is placed in the second air supply channel for air passage via the second air supply channel through the drum to the second air discharge channel. In that way it becomes possible to generate an air flow via the first wall through the drum to the second wall and to generate an air flow opposite thereto via the second wall through the drum to the first wall.

In one embodiment the first blower and the second blower are coupled to a driving shaft of one and the same drive mechanism. This measure makes it possible to save on elements of a drive mechanism, such as the use of only one motor, preferably an electromotor, for two blowers.

In one embodiment when driving the driving shaft in a first direction of rotation the first blower generates an air flow through the drum wherein an air flow generated by the second blower is substantially blocked by the first and second closing elements in the first position, and when driving the driving shaft in a second direction of rotation that is opposite the first direction of rotation, the second blower generates an air flow through the drum wherein an air flow generated by the first blower is substantially blocked by the first and the second closing elements in the second position. In that way it becomes possible when driving the driving shaft in the first direction of rotation to let the first blower, such as for instance a first volute blower, generate an air flow through the drum with high efficiency, whereas the second blower, such as for instance a second volute blower, which is then driven opposite its usual drive direction, only generates an air flow with a low efficiency. When driving the driving shaft in the second direction of rotation the second blower generates an air flow through the drum with a high efficiency, whereas the first blower only generates an air flow with a low efficiency.

In one embodiment the drive mechanism is coupled to the driving elements for rotating the drum. In that way it becomes possible when driving the driving shaft in a first direction of rotation to drive the first blower whereas the drum rotates along in the first direction of rotation, and when driving the driving shaft in the second direction of rotation to drive the second blower whereas the drum rotates along in a second direction of rotation.

According to a second aspect of the invention the tumble dryer comprises a drum that is rotatably positioned for containing laundry, and an air inlet system for supplying air to the drum, and a control system for controlling at least a drive of the drum and a blower, wherein a first stationary wall is placed near a first end surface of the drum and a second stationary wall is placed near a second end surface of the drum, wherein the first wall is provided with a first passage for air supply and a second passage for air discharge, and wherein the second wall is provided with a third passage for air supply, and a fourth passage for air discharge. In one embodiment a first outer rend of a first air supply channel is coupled to the first passage, a first outer end of a second air supply channel is coupled to a third passage, wherein a second outer end of the first and a second air supply channel are connected to the air inlet system, and a first outer end of a first air discharge channel is coupled to the fourth passage, a first outer end of a second air discharge channel is coupled to the second passage, wherein a second outer end of the first and a second air discharge channel are connected to an air outlet system.

In one embodiment the tumble dryer according to the second aspect of the invention comprises one or more of the said embodiments.

The tumble dryer according to the second aspect may be provided with an after-heating element.

The aspects and measures described in this description and the claims of the application and/or shown in the drawings of this application may where possible also be used individually. Said individual aspects may be the subject of divisional patent applications relating thereto. This particularly applies to the measures and aspects that are described per se in the sub claims.

SHORT DESCRIPTION OF THE DRAWINGS

The invention will be elucidated on the basis of a number of exemplary embodiments shown in the attached drawings, in which:

FIG. 1A schematically shows a tumble dryer provided with an air inlet system according to a first aspect of the invention;

FIG. 1B shows a view in perspective of a drum of a tumble dryer according to the invention;

FIG. 2 schematically shows a tumble dryer provided with first and second closing elements for directing a first and second air flow according to a second aspect of the invention;

Figure 7:
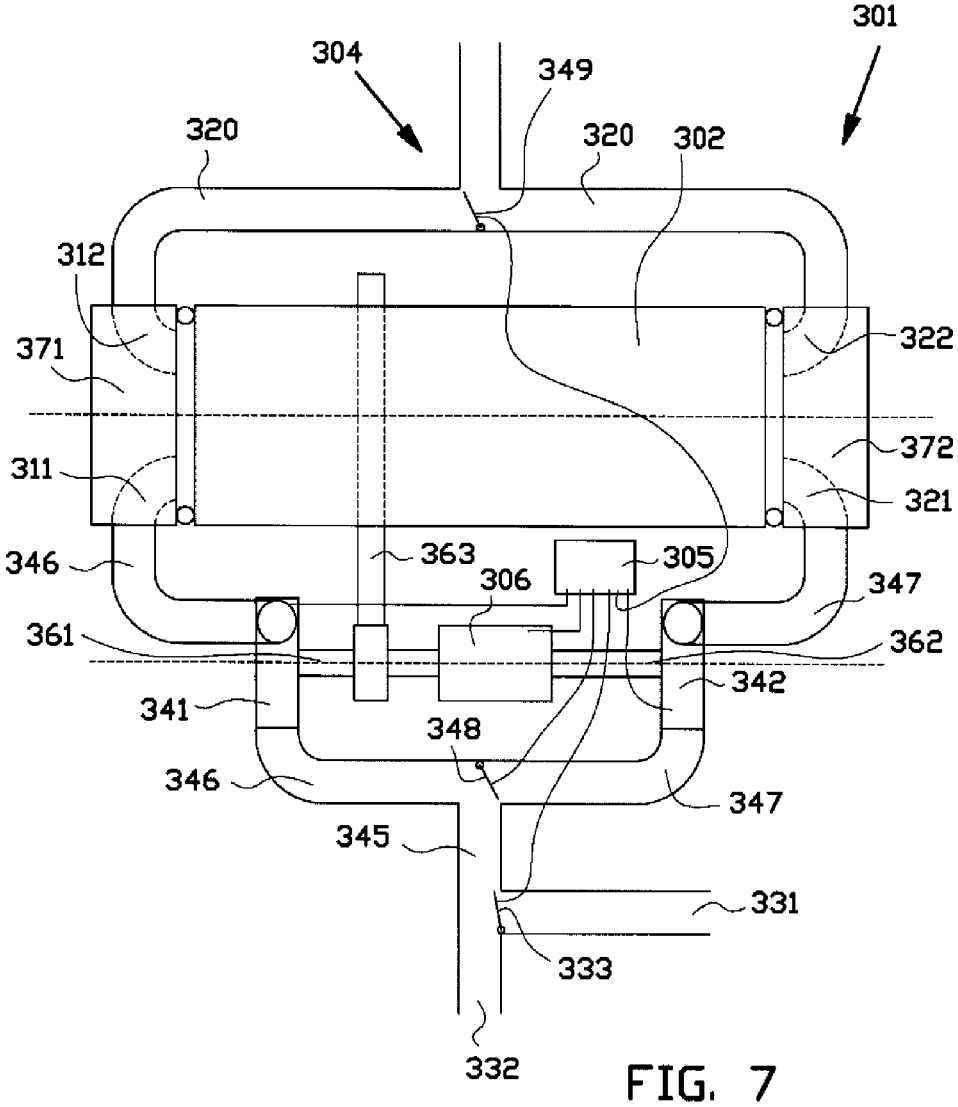
Figure 8:
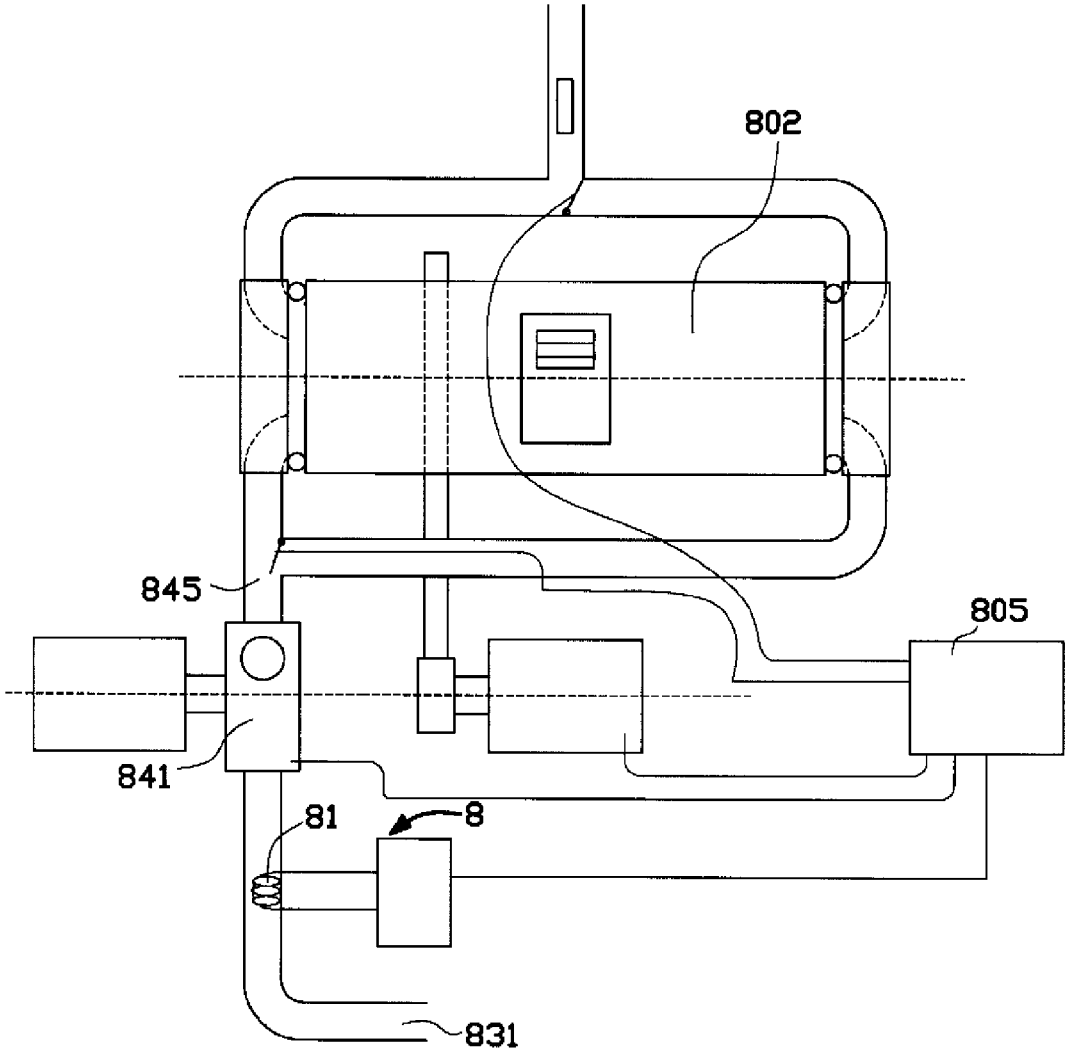
Figure 9A:
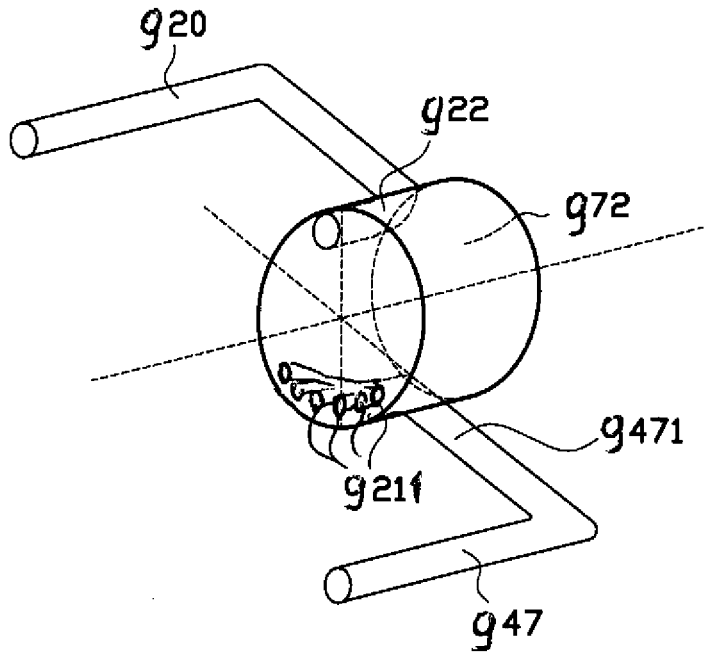
Figure 9B:
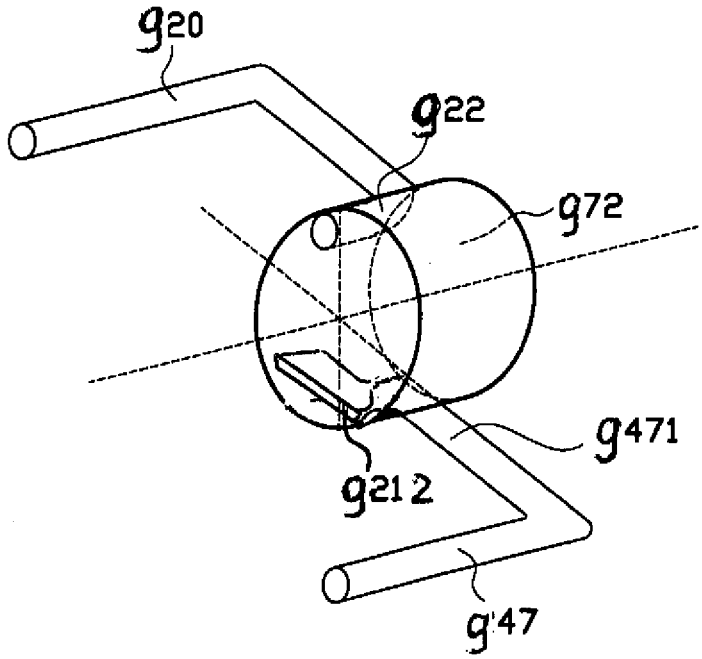

FIG. 7 schematically shows a tumble dryer wherein the drum during the first air flow rotates in opposite direction of a direction of rotation during the second air flow;

FIG. 8 schematically shows a tumble dryer wherein the first and second air flow can be alternated and provided with a heating element for heating the air sucked in;

FIG. 9A shows a schematic view in perspective of an air supply opening having several supply openings placed substantially horizontally adjacent to each other; and FIG. 9B shows a schematic view in perspective of an air supply opening having a substantially horizontally extending slit.

DETAILED DESCRIPTION OF THE DRAWINGS

Figure 1A:
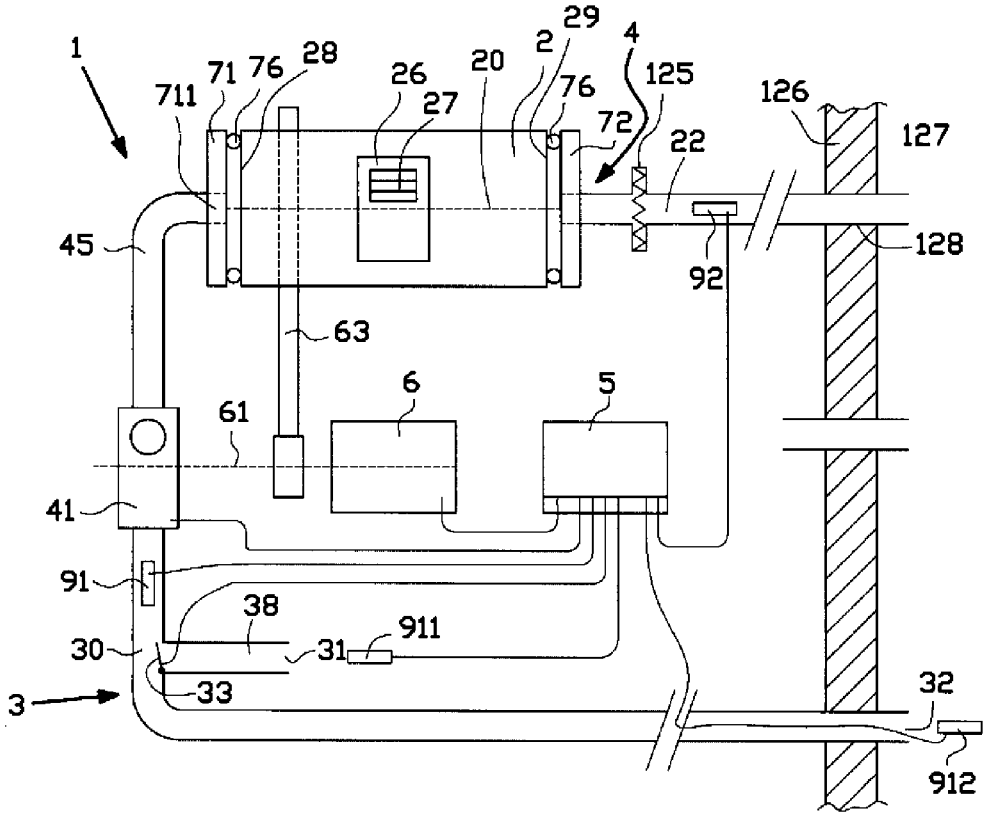

FIG. 1A shows parts of an improves tumble dryer 1 comprising a drum 2 for containing laundry between a first end surface 28 and a second end surface 29, which are situated on both sides of the drum 2, an air inlet system 3 for supplying air to the drum, a first blower 41 for generating an air flow through at least the drum 2, and a control system 5 for controlling at least an electromotor 6 for a drive of at least the drum 2 and the first blower 41.

The drum 2 is positioned so as to be rotatable about an axis of rotation 20, in this example between a first stationary wall 71 and a second stationary wall 72. The electromotor 6 can be controlled by the control system 5 for driving the drum 2 via a belt 63 of a belt transmission, which belt 63 is coupled to an outgoing shaft 61 of the electromotor 6.

The tumble dryer 1 can be adapted to be a top loader, wherein the drum 2 is provided with a hinging access lid 26 placed in a circumferential wall of the drum 2. The access lid 26 is provided with a handle 27 for opening and closing the drum 2 in a hinging manner.

Figure 1B:
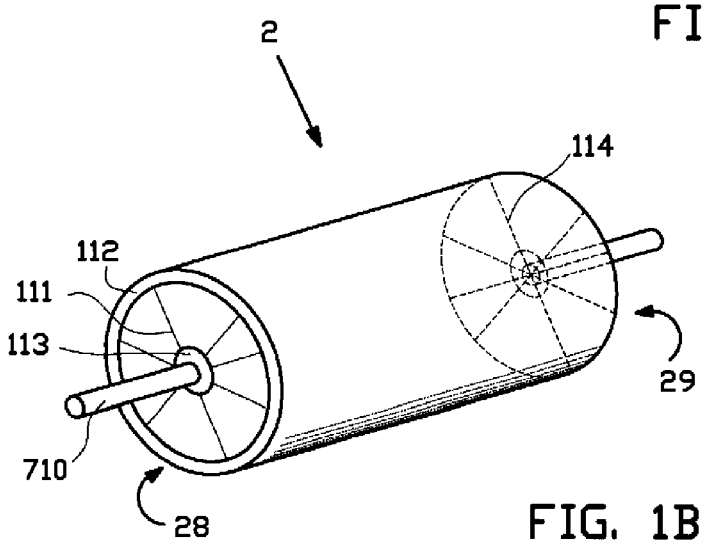

FIG. 1B shows that in this example near the first end surface 28 the drum 2 is provided with a first capstan wheel 111, wherein a wheel rim 112 is coupled to a head-end circumferential edge of the drum 2 and wherein a hub 113 is bearing-mounted in the known manner to a shaft 710 extending through the centre 711 of the first wall 71. Near the head-end circumferential edge of the drum 2, as shown in FIG. 1A, a sealing 76 is arranged which during use at least sufficiently seals off a volume enclosed by the drum 2. Near the second end surface 29 the drum 2 is provided in the same way with a second capstan wheel 114. In an alternative embodiment instead of the capstan wheels 111, 114 a differently shaped end member, such as for instance a covering cap or plate, can be used, optionally provided with substantially radial through-slots.

The tumble dryer 1 can be adapted as front loader, wherein the first wall 71 or the second wall 72 is provided with an access lid that is arranged so as to hinge in or parallel to the plane of the first wall 71 or the second wall 72. As a front loader the tumble dryer 1 is provided with a drum 2 which near the access lid does not comprise a capstan wheel, and is bearing-mounted within a housing of the tumble dryer in a known manner. The bearing-mounting of the drum 2 may near the access lid for instance engage onto a side of head-end circumferential wall of the drum 2, which side is oriented to the outside.

The tumble dryer 1 is provided with a first air supply channel 45 for supplying drying air. The first air supply channel 45 debouches into a passage in the first wall 71. Via the first air supply channel 45 an air flow can flow through the drum 2 that leaves the drum 2 via a passage in the second wall 72 to a first air discharge channel 22 of an air outlet system 4. In this example the first air discharge channel 22 is provided with a known fluff filter 125 in which fluff and dust can be left behind. In this example the first air discharge channel 22 is coupled to a wall passage 128 wherein air originating from the drum 2 is able to leave a space in which the tumble dryer 1 is placed, such as a room of a residence, via a hole 128 in a wall 126, wherein the air originating from the drum 2 preferably can be discharged to the outside 127.

The first air supply channel 45 is in fluid connection with an air inlet system 3. The air inlet system 3 has a first air inlet 38 having a first open outer end 31 for sucking in air from inside of the house, and has a first branching 30 to a second air inlet 39 having a second open outer end 32 for sucking in air from outside of the house. Near the first branching 30, the air inlet system 3 is provided with switching elements 33 operable by the control system 5, which switching elements in a first position effect sucking in air from inside of the house and in a second position sucking in air from outside of the house.

Figure 2:
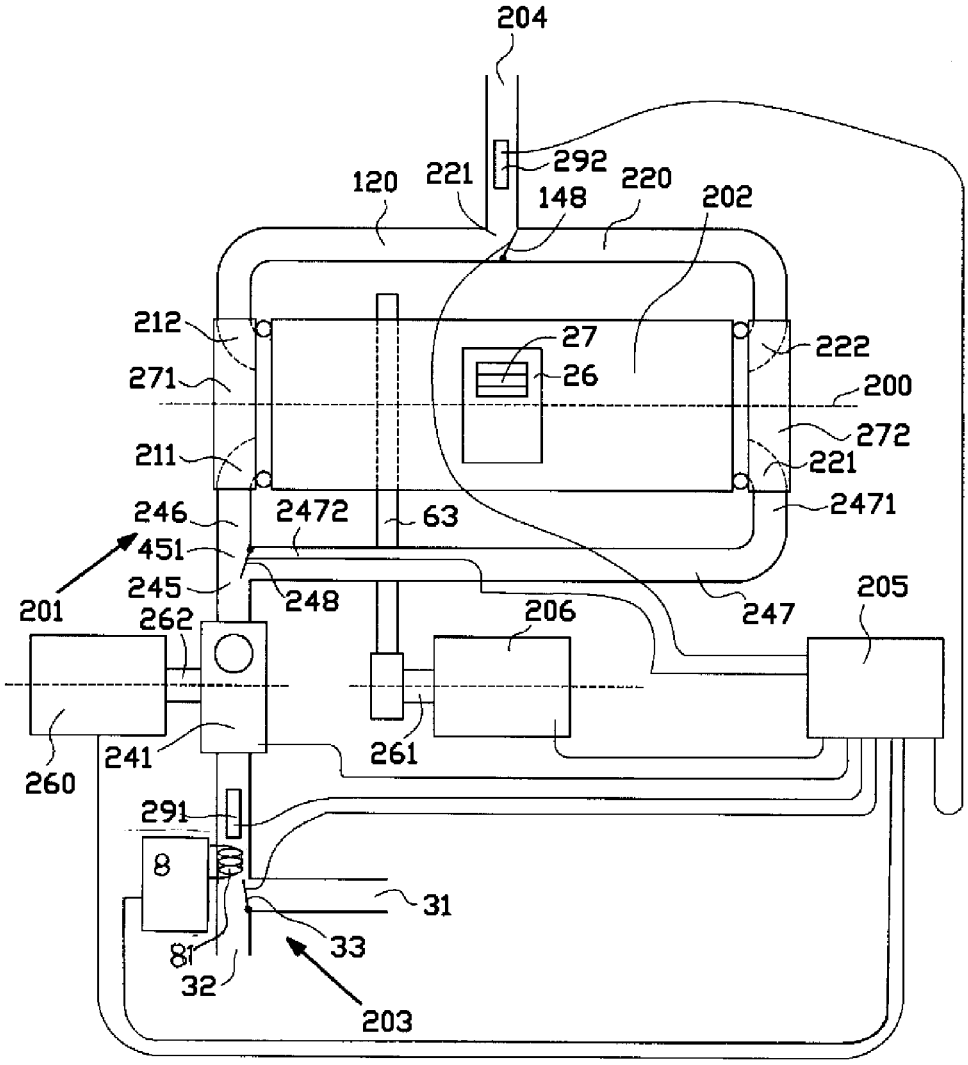

Optionally an after-heating device 8 for heating air to be supplied to the drum 202 can be placed near the air inlet system as schematically shown in FIG. 2. The after-heating device 8 is provided with a heating element 81 that is situated in the air supply channel. Although in FIG. 2 the heating element 81 is placed before the sensor 291 the heating element 81 can also be placed after the sensor 291.

FIG. 1A shows a first blower 41 that is suitable for sucking in air from inside of the house and/or from outside of the house and for generating an air flow from the air inlet system 3 through the drum 2 to the first air discharge channel 22 and the outside air 127. In this example the first blower 41 for generating an air flow is placed between the switching elements 33 of the air inlet system 3 and the first wall 71 of the drum 2.

In this example a first sensor 91 coupled to the control system 5 is placed between the switching elements 33 and the drum 2 for measuring the air humidity of the supplied inside air and/or the outside air. The control system 5 measures air humidity of sucked in inside air when the switching element 33, for instance designed as an operable valve, is in the first position. If the control system 5 measures air humidity when the switching element 33 is in the second position, the control system 5 measures the air humidity of the sucked in outside air.

The control system 5 is adapted for reading a signal for the value measured by the first sensor 91 for the air humidity of the inside air and/or the outside air, for processing it, and bringing and/or keeping the switching elements 33 in the first position if the measured air humidity of the inside air is substantially lower than the measured air humidity of the outside air and bringing and/or keeping the switching elements 33 in the second position if the measured air humidity of the inside air is substantially higher than the measured air humidity of the outside air.

Alternatively the first sensor 91 can be left out when a first air humidity sensor 911 is placed at least near the first outer end 31 of the air supply device 3 and a second air humidity sensor 912 is placed at least near the second outer end 32 of the air supply device 3. The control system 5 may then be adapted for reading the air humidity values measured with the first and second sensor 911, 912 at least almost simultaneously, processing and/or comparing them with each other and bringing and/or keeping the switching elements 33 in the first position if the measured air humidity of the inside air is substantially lower than the measured air humidity of the outside air and bringing and/or keeping the switching elements 33 in the second position if the measured air humidity of the inside air is substantially higher than the measured air humidity of the outside air.

A third sensor 92 is placed in the first air discharge channel 22, in this example between the fluff filter 125 and the wall 126, for measuring the air humidity of discharged air coming from the drum 2. The control system 5 is adapted for during the drying process continually reading and processing a signal for the value measured by the third sensor 92. As soon as the measured value is substantially lower than or equal to a reference value, the laundry is dry and the control system 5 switches off a drive of the tumble dryer 1. The reference value is a criterion on the basis of which the tumble dryer 1 switches off, for instance as soon as the air humidity of the air coming from the drum 2 is substantially equal to the air humidity of the air outside or inside of the house.

The control system 5 may if so desired switch off the tumble dryer 1 at a pre-programmed value, such as for instance at 60% air humidity in cases wherein the air both inside and outside of the house is lower than 60% air humidity.

FIG. 2 shows tumble dryer 201 wherein the first air supply channel 245 is provided with a second branching 451, and wherein the first air discharge channel 220 is provided with a third branching 221. For connection of the second 451 and the third 221 branching the first and the second stationary wall 271, 272 of the tumble dryer 201 are provided with several passages 211, 212, 221, 222.

The first wall 271 of the tumble dryer 201 is provided with a first passage 211, also called first air supply channel 211, for connection of the first air supply channel 245, which is divided in a first portion 245 and a second portion 246, wherein the second portion 246 connects to the first passage 211 of the wall 271. The first wall 271 is furthermore provided with a second passage 212, also called second air discharge channel 212, for connection of a second air discharge channel 120, which second air discharge channel 120 connects to the third branching 221 and is in fluid connection with the air outlet system 204.

When there is wet laundry in the drum 202, the laundry is situated substantially on an internal circumferential wall of the drum 202 that is situated near a lower side of the drum 202. The first passage 211 is arranged in the wall 271 near a lower side of the drum 202, as shown in FIG. 3.

In this example the first passage 211 is arranged such that a first outer end 2111 is radially oriented and a second outer end 2112 facing away from the first outer end is oriented substantially transverse to a plane 701 of the first wall 271 which plane faces the drum 202, wherein between the first outer end 2111 and the second outer end 2112 the first passage 211 runs curved at an angle of substantially 90 degrees. In order to prevent friction losses of the air inlet via the first passage 211 in the drum 202, the first passage 211 debouches near the second outer end 2112 within a diameter of the inwardly oriented side of the circumferential wall of the drum 202.

The first passage 211 is substantially spaced apart from the horizontal plane through the centre line 200 of the drum 202 and spaced apart from the vertical plane through the centre line 200 of the drum 202. Preferably the centre line of the first passage 211 extends in a plane in which the centre line 200 of the drum 202 is also situated, which plane extends substantially at an angle of 45 degrees to the said horizontal and/or vertical plane.

Figure 3:
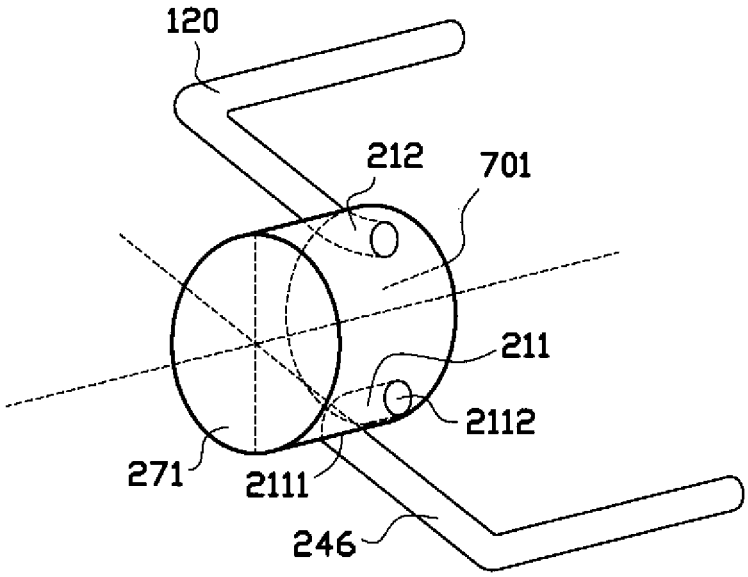
FIG. 3 shows a view in perspective of a first head-end wall placed near a first end surface of the drum of the tumble dryer according to the second aspect of the invention.

Near an upper side of the tumble dryer 201, as shown in FIG. 3, the second passage 212 is arranged in the wall 271 that is arranged in a curved manner analogous to the first passage 211 and is situated substantially diametrically with respect to the first passage 211.

The second wall 272 as for instance shown in FIG. 2, is provided with a third passage 221, also called second air supply opening 221, for connection of a first outer end 2471 of a second air supply channel 247, wherein a second outer end 2472 of the second air supply channel 247, which outer end faces away from the first outer end 2471, is connected to the second branching 451. The second wall 272 is further provided with a fourth passage 222, also called first air discharge opening 222, for connection of the first air discharge channel 220, which first air discharge channel 220 connects to the third branching 221 and is in fluid connection with the air outlet system 4.

Figure 4:
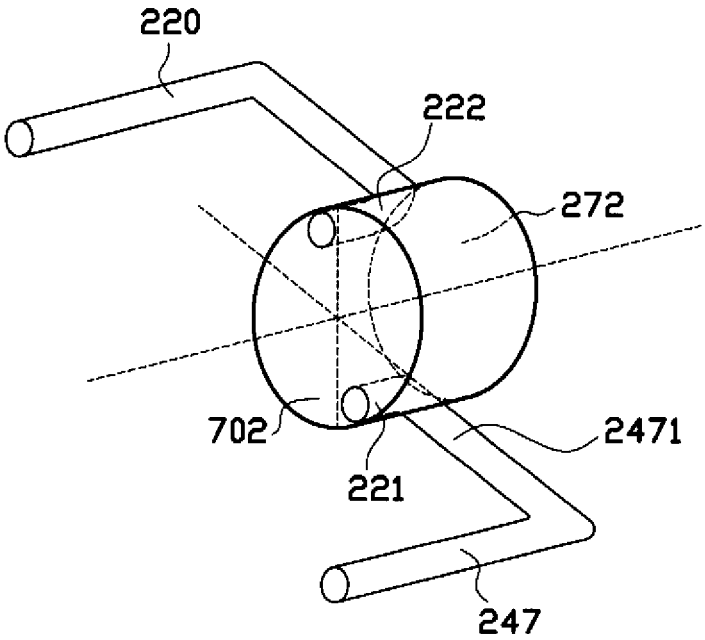
FIG. 4 shows a view in perspective of a second head-end wall placed near a second end surface of the drum of the tumble dryer according to the second aspect of the invention.

FIG. 4 shows the second wall 272, which in the mounted condition, is situated substantially mirror-symmetrical in the centre plane M of the drum 202, wherein the centre plane M extends transverse to the centre line 20 of the drum 202. In a plane 702 facing the drum 202, the third and fourth passage 221, 222 in an analogous manner to the first and second passage 211, 212 debouch in the plane 701 of the first wall 271, which plane is oriented towards the drum 202. The third and the fourth passage 221, 222 in an analogous manner to the first and the second passage 211, 212 in the first wall 271 are also arranged in a curved manner in the second wall 272, wherein the third and fourth passage 221, 222 are situated in a centre plane M of the drum 202 substantially mirror-symmetrical to the first and the second passage 211, 212.

Near the second branching 451 first closing elements 248 are arranged for closing off and opening the second portion 246 of the first air supply channel and/or the second air supply channel 247, which first closing elements 248 are operable by the control system 205 for directing an air flow through the drum 202.

Near the third branching 221 second closing elements 148 are arranged for closing off and opening the first air discharge channel 220 and/or the second air discharge channel 120, which second closing elements 148 are operable by the control system 205 for directing an air flow through the drum 202.

By operating the first blower 241 and the first and second closing elements 248, 148, the control system 205 can generate a first or second air flow through the drum 202.

Figure 5:
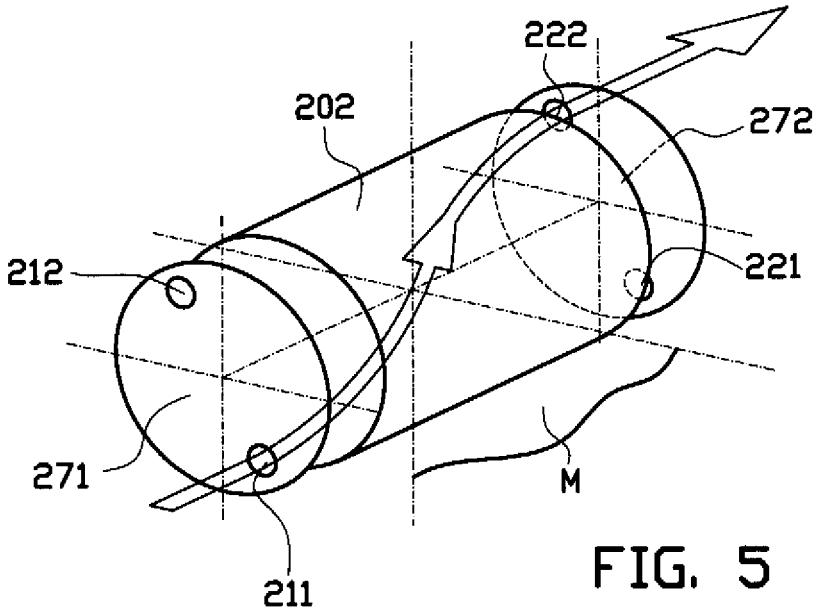
FIG. 5 shows a view in perspective of a first air flow through the drum of the tumble dryer according to the second aspect of the invention.
Figure 6:
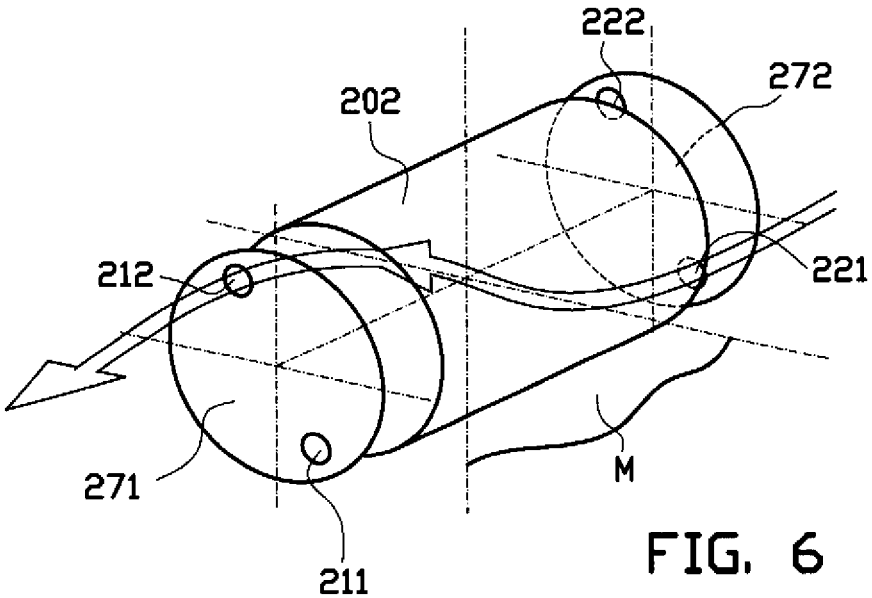
FIG. 6 shows a view in perspective of a second air flow through the drum of the tumble dryer according to the second aspect of the invention.

FIGS. 5 and 6 each show the drum 202 placed between the first stationary wall 271 and the second stationary wall 272. The first stationary wall 271 is provided with the first and the second passage 211, 212, and the second stationary wall 272 is provided with the third and fourth passage 221, 222.

FIG. 5 shows the first air flow, which enters via the first passage 211 and leaves the drum 202 via the fourth passage 222. For generating the first air flow according to FIG. 2 the control system 205 is adapted for bringing the first and the second closing elements 248, 148 in a first position wherein the first closing elements 248 substantially close off the second air supply channel 247 and the second closing elements 148 substantially close off the second air discharge channel 120. The first air flow passes in a substantially diagonal direction through the drum 202.

FIG. 6 shows the second air flow, which enters via the third passage 221 and leaves the drum 202 via the second passage 212. For generating the second air flow, according to FIG. 2 the control system 205 is adapted for bringing the first and the second closing elements 248, 148 in a second position wherein the first closing elements 248 substantially close off the second portion 246 of the first air supply channel 245 and the second closing elements 148 substantially close off the first air discharge channel 220. The second air flow passes in a substantially diagonal direction through the drum 202, which in the longitudinal direction of the drum 202 is oriented substantially opposite the first air flow.

The control system 205 is adapted for alternating the first air flow by the second air flow. Alternating the first and second air flow ensures that pieces of laundry that for instance during the first air flow are substantially situated outside of the moisture-absorbing and moisture-discharging first air flow, during the second air flow end up substantially within the moisture-absorbing and moisture-discharging second air flow. By alternating the first air flow by the second air flow the drying process is improved and accelerated.

The third sensor 292 that is arranged in the air outlet system 204 is adapted for giving a third signal to the control system 205, which signal corresponds with the air humidity of the air discharged from the drum 202. As long as both the air humidity of the first and the second air flow measured by the third sensor 292 are substantially higher than the reference value, the control system 205 periodically switches the closing means 248, 148 between the first position and the second position for an alternation between the first and the second air flow.

However, the control system 205 also switches the closing means 248, 148 between the first position and the second position as soon as only one air humidity of the first air flow or the second air flow measured by the third sensor 292 is substantially lower than the reference value. Locally wet pieces of laundry may end up in a corner where there is no powerful air flow for absorbing moisture and discharging humid air. For instance in case of the first air flow the humidity of the discharged air may be lower than the reference value and immediately after switching from the first to the second air flow the humidity of the discharged air may be higher than the reference value. The control system 205 preferably is adapted such that the tumble dryer 201 is not switched off until the humidity for both the first and the second air flow measured by the third sensor 292 is substantially lower than a reference value.

In the example according to FIG. 2 the control system 205 is able to control the electromotor 206 as first electromotor 206 for driving the drum 202 via a first shaft end 261 in two directions of rotation, and control a second electromotor 260 for driving the first blower 241, in this example a volute blower, via a second shaft end 262. Driving the first blower 241 preferably takes place in one direction of rotation, wherein with sufficient efficiency an air flow can be generated through the drum 202. When driving the first blower 241 by the second electromotor 260 in opposite direction of rotation the first blower 241 has insufficient efficiency to generate a drying air flow through the drum 202.

The electromotor 260 can be saved on by coupling the first blower 241 for driving to the first electromotor 206, wherein driving the blower 241 in one direction only can be limited to, wherein the blower 241 is able to generate an air flow through the drum 202 with sufficient efficiency, wherein the saving results in the drum 202 being able to be driven in one direction of rotation only.

FIG. 7 shows a tumble dryer 301 that is suitable for driving the drum 302 in two directions of rotation for further enhancement of the drying process. The electromotor 306 can be controlled by the control system 305 in order to drive the drum 302 in two directions of rotation via a belt 363 of a belt transmission, which belt 363 in this example is coupled to a first outgoing shaft 361 of the electromotor 306.

With respect to FIG. 2, the first ventilator 341 is moved to the second portion 346 of the air supply channel 345 and a second blower 342 is placed in the second air supply channel 347. In this example the first and the second blower 341, 342 are coupled to a common through-shaft 361, 362. In this example the first blower 341 is coupled to the first shaft end 361 of the electromotor 306 whereas the second blower 342 is coupled to a second shaft end 362 of the electromotor 306.

The first blower 341 is placed such on the first shaft end 361 that optimal efficiency is provided when driving in a first direction of rotation, whereas minimal efficiency is provided when driving in a second direction of rotation that is oriented opposite to the first direction of rotation. When driving the driving shaft 361, 362 in the first direction of rotation the first blower 341 generates an air flow through the drum 302, whereas the first and the second closing elements 348, 349 in the first position substantially block an air flow generated by the second blower 342.

The second blower 342 is coupled such to the second shaft end 362 that optimal efficiency is provided when driving in the second direction of rotation, whereas minimal efficiency is provided when driving in the first direction of rotation. When driving the driving shaft 361, 362 in the second direction of rotation the second blower 342 generates an air flow through the drum 302, whereas the first and the second closing elements 348, 349 in the second position substantially block an air flow generated by the first blower 341.

When using the first and the second blower 341, 342 optionally the second closing elements 349 can be left out, wherein a first air flow effectively absorbs moisture and discharges humid air from the drum 302 and wherein a second air flow as a relatively weak opposite air flow forms a counter pressure and offers sufficient resistance for at least partially blocking the related air supply channel.

The tumble dryer 201, 301 according to the above-mentioned description is suitable for drying wet laundry, wherein air is alternately blown through the drum 202, 302, wherein entering air is relatively dry and exiting air is relatively humid. The tumble dryer 1, 201, 301 can be provided with an after-heating device 8 that is known per se, for heating air to be supplied to the drum 802, as shown in FIG. 8. The after-heating device 8 is provided with an after-heating element 81 which in this example is situated in an air supply channel 845 and is suitable for when operative being controlled by the control system 805 for delivering heat to the air which via the air inlet 831 via the blower 841 flows to the drum 802.

The tumble dryer 801 that is provided with the after-heating device 8 makes use of the effect that air is able to absorb more moisture the higher its temperature. The after-heating device 8 can be added to each of the embodiments described above for speeding up the drying process of wet laundry.

FIG. 9A shows a further embodiment of the second wall 972, wherein the plane facing the drum is provided with the third and the fourth passage 9211, 922. In this embodiment the outer end 9471 of an air supply channel 947 is coupled to a series of supply openings 9211 which are placed near the lower side of the plane facing the drum. The series of supply openings 9211 is placed substantially along the circumference of the plane facing the drum and spaced apart from the edge of said plane. Said series of supply openings 9211 is in this example combined with a single air discharge opening 922 that is coupled to an air discharge channel 920. The first wall of the tumble dryer according to this example can also be designed in an analogous manner.

FIG. 9B shows an embodiment of the second wall 972, wherein the plane facing the drum is provided with the third and the fourth passage 9212, 922, wherein the outer end 9471 of an air supply channel 947 is coupled to a slit-shaped supply opening 9212. The slit-shaped supply opening 9212 extends substantially horizontally and is placed near the lower side of the plane facing the drum and spaced apart from the edge of said plane. In this example said slit 9212 is combined with a single air discharge opening 922 that is in connection with an air discharge channel 920. The first wall of the tumble dryer according to this example can also be designed in an analogous way.

The above description is included to illustrate the operation of preferred embodiments of the invention and not to limit the scope of the invention. Starting from the above explanation many variations that fall within the spirit and scope of the present invention will be evident to an expert.

The invention claimed is:

1. Tumble dryer comprising a drum that is rotatably positioned for containing laundry, and an air inlet system for supplying air to the drum, and a control system for controlling at least a drive of the drum and a blower, wherein the drum is rotatable about an axis of rotation between a first stationary wall and a second stationary wall, wherein the first stationary wall is placed near a first end surface of the drum and the second stationary wall is placed near a second end surface of the drum, wherein the first wall is provided with a first air supply opening and the second wall with a first air discharge opening, wherein the first air supply opening is placed substantially at a lower side of the first wall, in that the first air discharge opening is placed substantially at an upper side of the second wall, and wherein the blower is placed upstream from the first air supply opening for blowing air through the first air supply opening into the drum, wherein the second wall is provided with a second air supply opening for allowing air to enter the drum through the second air supply opening, wherein the second air supply opening is placed substantially at a lower side of the second wall.

2. Tumble dryer according to claim 1, wherein the air inlet system is adapted for blowing air into the drum one of alternately or simultaneously through the first and the second air supply opening.

3. Tumble dryer according to claim 1, wherein the first wall is provided with a second air discharge opening, and wherein the second air discharge opening is placed substantially at an upper side of the first wall.

4. Tumble dryer according to claim 3, wherein the tumble dryer is adapted for discharging air out of the drum alternately via the first and the second air discharge opening.

5. Tumble dryer according to claim 1, wherein the first wall is provided with a second air discharge opening, and wherein the second air discharge opening is placed substantially at an upper side of the first wall, wherein the tumble dryer is adapted for discharging air out of the drum alternately via the first and the second air discharge opening.

6. Tumble dryer according to claim 5, wherein the first air supply opening and the second air discharge opening are placed substantially diametrically to a centre line of the drum and near the circumferential wall of the first wall and/or wherein the second air supply opening and the first air discharge opening are placed substantially diametrically to a centre line of the drum and near the circumferential wall of the second all.

7. Tumble dryer according to claim 5, wherein the tumble dryer is adapted for alternately generating a first and second air flow, wherein the first air flow enters the drum via the first air supply opening and leaves the drum via the first air discharge opening, and wherein the second air flow enters the drum via the second air supply opening and leaves the drum via the second air discharge opening.

8. Tumble dryer according to claim 7, wherein the tumble dryer is adapted for during alternately generating the first and second air flow, keeping the direction of rotation of the drum substantially the same.

9. Tumble dryer according to claim 1, wherein the first and second end surface of the drum are provided with a shaft, wherein the shaft on both sides of the drum is rotatably connected, particularly via a bearing, to the first and second stationary wall, respectively.

10. Tumble dryer according to claim 1, wherein the air inlet system comprises a branching for sucking in air, and that the air inlet system comprises first switching elements for switching between a first condition wherein the air inlet is in fluid connection with the first air supply opening and a second condition wherein the air inlet is in fluid connection with the second air supply opening.

11. Tumble dryer according to claim 10, wherein the control system is adapted for operating at least the first switching elements.

12. Tumble dryer according to claim 1, characterised in that the blower is adapted for, at least when operational, supplying a flow rate to the drum, wherein the flow rate is in a range of 600 to 1600 times the volume of the drum per hour.

13. Tumble dryer according to claim 1, characterised in that the blower is adapted for, at least when operational, supplying a flow rate to the drum, wherein the flow rate exceeds 600 $m^3$ per hour.

14. Tumble dryer according to claim 1, wherein the tumble dryer is adapted for drying laundry in the drum using an air flow at a substantially ambient temperature of the air.

15. Tumble dryer according to claim 1, wherein the tumble dryer is provided with an after-heating element, and wherein the control device is adapted for controlling the after-heating element for, when necessary, at or towards the end of the drying process heating the air flow for drying the laundry.

16. Tumble dryer according to claim 15, wherein the control device is adapted for switching on the after-heating element when the humidity level of the inflowing air is 70% or higher.

17. Tumble dryer according to claim 15, wherein the control device is adapted for switching on the after-heating element after a pre-set time period of drying without after-heating element.

18. Tumble dryer according to claim 15, wherein the control device is adapted for switching on the after-heating element when the humidity level of the laundry substantially equals the air humidity of the in flowing air.

19. Tumble dryer according to claim 1, wherein the first air supply opening comprises a substantially horizontally extending slit or several supply openings placed substantially horizontally adjacent to each other for supplying a substantially in horizontal direction wide air flow to the lower side of the first wall.

20. Tumble dryer according to claim 13, wherein the blower is adapted for, at least when operational, supplying a flow rate to the drum, wherein the flow rate exceeds 800 $m^3$ per hour.

21. Tumble dryer according to claim 13, wherein the blower is adapted for, at least when operational, supplying a flow rate to the drum, wherein the flow rate exceeds 1000 $m^3$.

22. Tumble dryer according to claim 17, wherein the pre-set time period is longer than or equal to 1 hour.

23. Tumble dryer according to claim 17, wherein the pre-set time period is longer than or equal to 2 hours.

* * * * *